US011460180B1

(12) United States Patent
Winton et al.

(10) Patent No.: US 11,460,180 B1
(45) Date of Patent: Oct. 4, 2022

(54) DRIVER-ON-BOARD LED LUMINAIRE

(71) Applicant: Radionic Hi-Tech, Inc., Chicago, IL (US)

(72) Inventors: Jeffrey Winton, Chicago, IL (US); Sri Sridharan, Hickory Hills, IL (US)

(73) Assignee: Radionic Industries, Inc., Chicago, IL (US)

( * ) Notice: Subject to any disclaimer, the term of this patent is extended or adjusted under 35 U.S.C. 154(b) by 0 days.

(21) Appl. No.: 17/134,015

(22) Filed: Dec. 24, 2020

Related U.S. Application Data

(60) Provisional application No. 62/995,693, filed on Feb. 10, 2020.

(51) Int. Cl.

| | |
|---|---|
| ***F21V 23/00*** | (2015.01) |
| ***F21V 23/04*** | (2006.01) |
| ***F21V 3/06*** | (2018.01) |
| ***G09F 13/04*** | (2006.01) |
| ***G09F 13/22*** | (2006.01) |
| ***G09F 13/18*** | (2006.01) |
| ***G08B 7/06*** | (2006.01) |
| *F21W 111/00* | (2006.01) |
| *F21Y 115/10* | (2016.01) |

(52) U.S. Cl.
CPC ..... *F21V 23/005* (2013.01); *F21V 3/0625* (2018.02); *F21V 23/0457* (2013.01); *F21W 2111/00* (2013.01); *F21Y 2115/10* (2016.08); *G08B 7/062* (2013.01); *G09F 13/04* (2013.01); *G09F 13/18* (2013.01); *G09F 2013/222* (2013.01)

(58) Field of Classification Search
CPC ..... G09F 13/04; G09F 13/18; G08B 7/062; F21V 23/005; F21V 23/0457; F21V 3/0625
See application file for complete search history.

(56) References Cited

U.S. PATENT DOCUMENTS

| | | | | |
|---|---|---|---|---|
| 8,754,778 | B2 | 6/2014 | Winton | |
| 8,911,134 | B2 * | 12/2014 | Hsu | G09F 13/18 362/613 |
| 9,374,856 | B2 | 6/2016 | Winton | |
| 9,750,094 | B1 | 8/2017 | Winton | |
| 2011/0210861 | A1 * | 9/2011 | Winton | G08B 7/062 340/815.45 |
| 2014/0204572 | A1 | 7/2014 | Spinelli | |

* cited by examiner

*Primary Examiner* — Rajarshi Chakraborty
*Assistant Examiner* — Nathaniel J Lee
(74) *Attorney, Agent, or Firm* — Clifford H. Kraft

(57) ABSTRACT

A Light Emitting Diode (LED) Luminaire retrofit kit used with Exit Signs. This kit has an integral Driver On-Board (DOB) . The integrated Circuit Chip (IC Chip) on Printed circuit Board (PCB) eliminates the need for a separate LED Driver to drive the LEDs is on Board. The PCB includes a metal oxide varistor (MOV), and an array of Light Emitting Diodes (LEDs) arranged in an optimized configuration. An integral plastic Diffuser provides a uniform Light to the exit sign. All the components are laid out in a single low profile PC Board. The system provides maximum power output consuming very low input power. The system can operate at 120 or 277 Volts 60 Hz. The specially designed diffuser is positioned over LEDs for uniform illumination over desired area eliminating the Dot Matrix Pattern produced by LEDs. The luminaire can be made to varying lengths.

19 Claims, 5 Drawing Sheets

DRIVER-ON-BOARD LED LUMINAIRE

This application is related to, and claims priority from, U.S. Provisional Patent Application No. 62/995,693 filed Feb. 10, 2020. Application 62/995,693 is hereby incorporated by reference in its entirety.

BACKGROUND

Field of the Invention

The present invention relates to LED signs, and more particularly to an LED exit sign using light-weight LEDs with an onboard IC driver, and may also be used in other applications where a thin LED board with no extra power supply is appropriate.

Description of the Problem Solved

There has been a need for developing an energy efficient LED Luminaire without a separate LED Driver that adds extra weight and cost to the unit. Elimination of driver not only reduces the overall weight, but also the need for external wiring from the LED strip to line power. There is a need for an exit sign retrofit kit using modern low weight LEDs with drivers on the same board.

LED's, produce colored light that does not need to be filtered—all of the energy is concentrated around a single color band, and none is "wasted" on undesired colors. LED's presently use compound semiconductors. The color of the light is determined by the band gap of the semiconductor. LED's using AlInGaP compound semiconductor alloys can emit in the yellow-red spectrum, while LED's using AlInGaN compound semiconductor alloys can emit in the UV-blue-green spectrum. A combination of red, green, and blue LED's, or a blue or UV LED with phosphors can be used to create white light.

The Light Emitting Diode emits electromagnetic waves in the visible portion of the electromagnetic spectrum. LED's do not contain mercury and are environmentally friendly. Most of the prior art LED luminaire have external drivers.

SUMMARY OF THE INVENTION

The luminaire of the present invention has no separate LED driver. All components on laid out on single board. An IC Chip drives the LED in groups. The circuit uses very few external components making the luminaire more efficient and reliable. The LEDs are allocated into arrays prior to manufacture using an optimization technique. The LED arrays are chosen to produce color temperature between 2500 to 500 degrees K.

DESCRIPTION OF THE FIGURES

Attention is not directed to several figures that illustrate features of the present invention.

Several illustrations have been presented to aid in understanding the invention. The scope of the present invention is not limited to what is shown in the figures.

DESCRIPTION OF THE PREFERRED EMBODIMENT

The design includes a single CL-1581 LED controller integrated circuit (IC) driver Chip manufactured by Chip-Link Corp having less weight and needing very few external components compared to prior art LED circuits, thereby increasing the reliability. In addition, the heat dissipated by the IC Chip is very low as compared to a traditional LED driver, thereby eliminating the need for a heat sink. All components, including a Metal oxide Varistor (MOV), fuse, IC Chip and LED arrays are laid on a single Printed Wiring Board (PCB). This luminaire can be fitted as well with an optional Light diffuser. The design can be used with edge-Lit or center-Lit Exit Sign systems.

The input voltage of 120V or 277 V 60 60 Hz, is electrically parallel connected to a Metal Oxide Varistor MOV) that absorbs electrical high-voltage transients. A series fuse feeds a Bridge rectifier which converts the AC voltage into DC half waves. The rectified voltage is fed into a controller chip that is rated to 700VAC, 60 mA, which controls the input current to four series arrays of LEDs. The chip contains switching regulator-based LED drivers that support driving white LEDs in series, parallel or a combination of both. This controller adjusts the LED array current through external resistors to approximately within 4 percent. It requires 120VAC or 277VAC, 60 Hz, and it has a self-regulating network to keep the temperature rise under control. An input resistor R2 (typically 510 k-ohm) limits the input current to the IC Controller. R3 is a line voltage-compensating resistor, while C1 is an external filter capacitor. Resistor R1 sets the LED string current.

The control IC Chip feeds the divided the rectified DC voltage proportionately to each LED array by segments with a computed number of LEDs in each segment.

Figure 1:
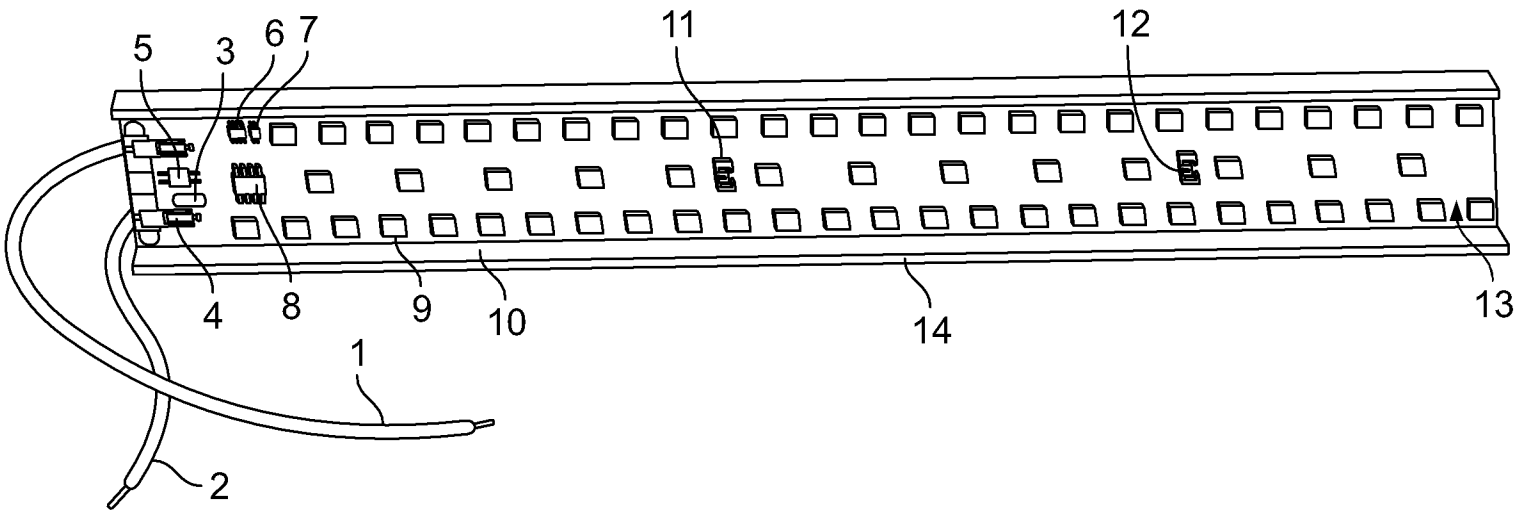
FIG. 1 shows the layout of components of the circuit.

FIG. 1 shows the layout of components of the circuit. The PC board is shown as 14. The power input leads are 1 and 2. The fuse is shown as 3, and the input terminals are shown as 4 and 5. Resistors are shown as 6, 11, 12 and 13. The IC is shown as 7, and the bridge rectifier is shown as 8, with LEDs shown as 9 and 10.

Figure 2:
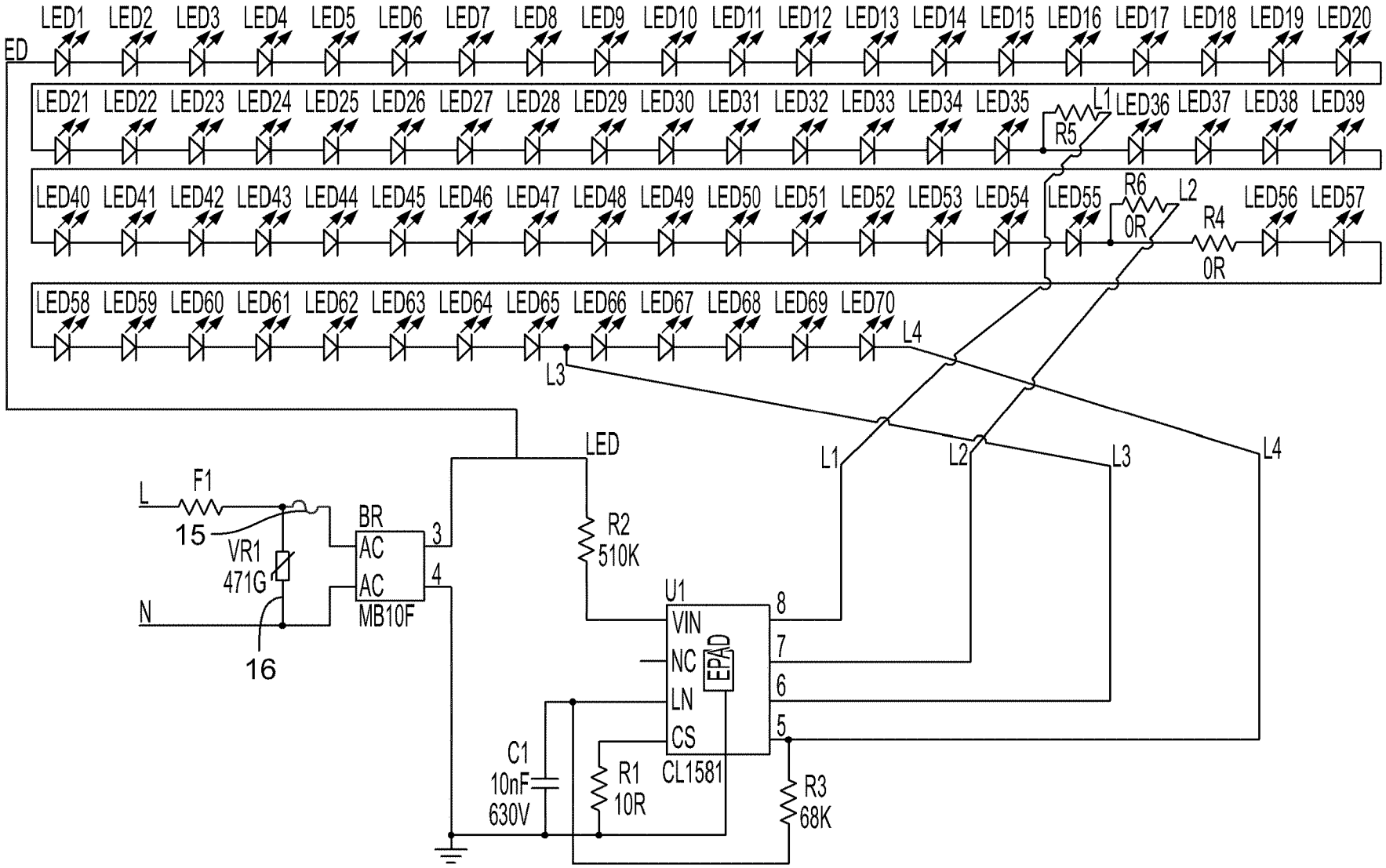
FIG. 2 is a schematic of the circuit with components values marked and their interconnections.
Figure 3:
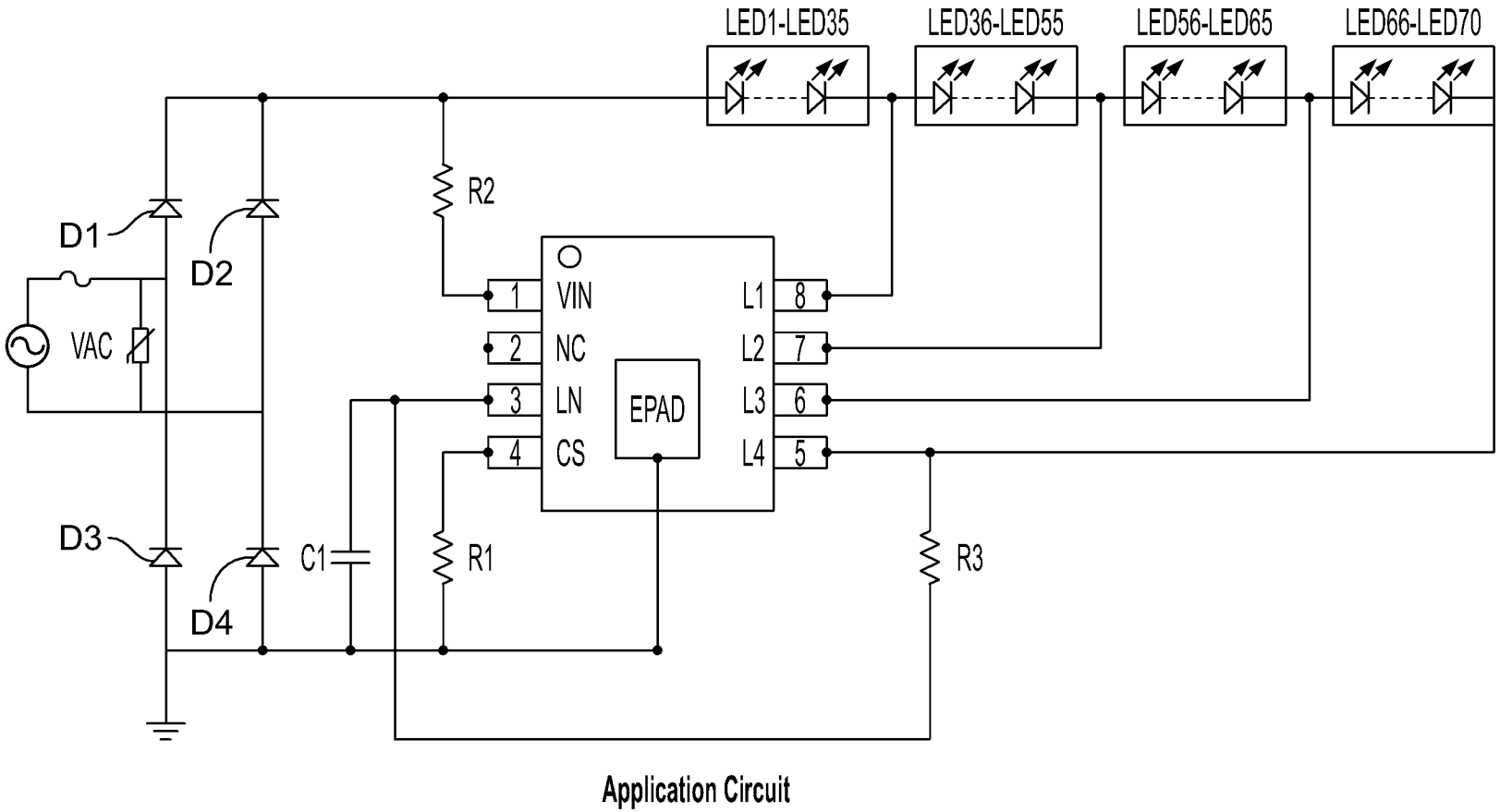
FIG. 3 shows the application of the circuits with LEDs grouped.
Figure 4:
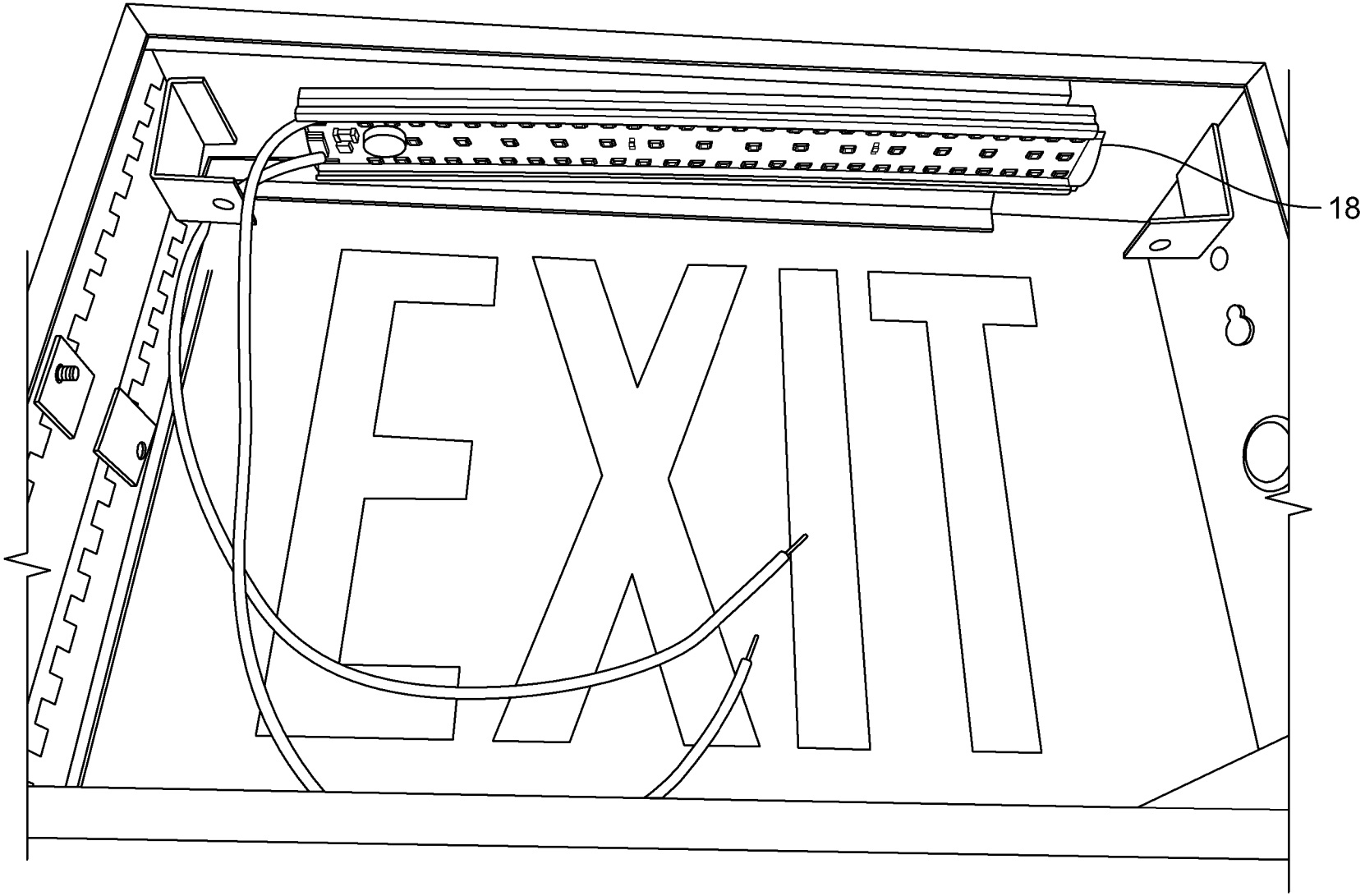
FIG. 4 shows the end use application of the Luminaire in vertical mounted position in an exit sign
Figure 5:
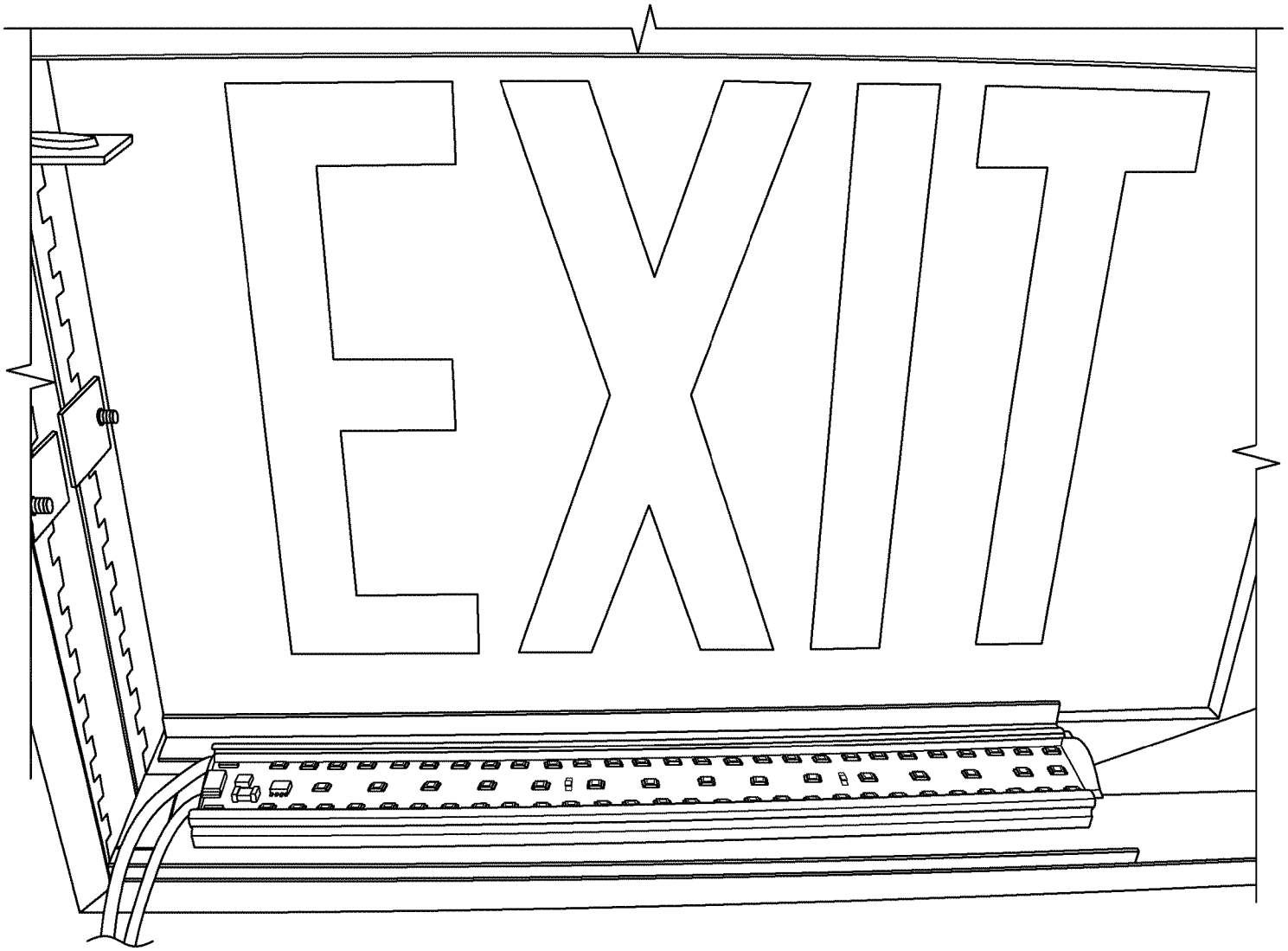
Fig. 5 shows the end use application of the luminaire in a bottom mounted position in an exit sign.

FIG. 2 Shows the schematic of the circuit with individual component values The input Slow Blow fuse is shown as 15, while the metal Oxide Varistor (MOV) is shown as 16. FIG. 3 shows the application of the circuits with LEDs grouped. D1, D2, D3, and D 4 are the diodes contained in the Bridge rectifier. FIG. 4 shows the end use application of the Luminaire in vertical mounted position in an Exit Sign. The top mounting is illustrated with an optional diffuser. The word EXIT is stenciled. Fig. 5 shows an end-use application of the luminaire in a bottom mounted position in an exit sign.

The luminaire's efficacy is defined as ratio between the output lumens to the input power in watts. The luminaire design of the present invention yields maximum Efficacy values of 128 at 120 V, 60 Hz and 125 at 277V, 60 Hz.

The luminaire operates from a rectified 60 Hz low frequency sine waves. The absence of magnetically created high frequency, typically several MHz voltage waves used in switching power supplies means that no high frequency electromagnetic interference (EMI) is created by radiation or direct coupling. Consequently, no additional EMI suppressing components such as expensive chokes, capacitors, transorbs or filter networks are needed. Also, no additional Federal Communication Commission (FCC) or other regulatory approval is necessary. In particular, no regulatory radiated emission testing is required.

The LED arrays are chosen to produce color temperature between 2500 to 500 degrees K.

Array Allocation

The total number of LEDs are in each group is chosen by the designer depending on the length and layout limitations. Optimization is done by the designer prior to manufacture using a trapezoid method. The area under the voltage curve represents the available power is optimized to achieve a high degree of efficiency. The optimization takes place as follows:

The period of the rectified 60 Hz sinewave exiting the bridge rectifier is 8.3 mS (since 60 Hz corresponds to full period of 16.6 mS; half of this is 8.3 m Sec).

The integral of sin(x)dx between 0 and pi equals 2(−cos (x)) [from 0 to pi/2]=2 sq. units (the units depend upon the peak voltage). This is the power area under sinewave and can be optimally distributed among 70 LEDs in 4 separate arrays as follows:

50% of 2 sq. units of power area=1 sq. unit of power area. Thus, place half the LEDs in the first unit of power area). The first array gets 35 LEDs. There are 35 remaining LEDs still unassigned to an array.

The remaining power area of 1 sq. unit can be shared by the remaining 3 arrays of LEDs as follows:

- 25% of total 2 sq. unit of power area is approximately=20 LEDs.
- 12.5% of the total 2 sq. unit of power area is approximately=10 LEDs.
- 6.25% of the total 2 sq. unit of power area is approximately=5 LEDs.

The 2 sq. unit total power area is thus optimally distributed among 4 Trapeziums (see FIG. 6) with an approximation to the number of LED's in each array. In this example, the total area adds up to 95% of sine wave total power area because of approximations.

A more general case involves N LEDs total to be optimally divided into K arrays where K<<N and a waveform or functional voltage curve f(x) with a period of pi radians:

Integrate f(x)dx from 0 to pi to find the total power area in sq. power units A (again multiply A by the peak voltage to find actual power). Allocate K/A LEDs into the first square power unit. Distribute the remaining N−K/A LEDs into the remaining sq. power units by dividing the remaining number of LEDs by A for each allocation. Thus for arrays k1, k2, k3, . . . K, allocate the number of LEDs in each array n1, n2, n3 . . . as:

n1=K/A, n2=(K−n1)/A n3=(K−n1−n2)/A n4=(K−n1−n2−n2)/A

Etc.

In other words, keep dividing the remaining number of LEDs by A. It should be noted that in the general case (non-sinusoidal), A may be a real number. In each case, after division by A, the number of LEDs in a particular array should be rounded to the nearest positive integer.

Thus for the example cited, N=70, K=4, and A=2. Thus:

n1=70/2=35 n2=35/2=17.5 (could be rounded to 18, but was rounded to 20).

n3=18/2=9 (since n2 was rounded to 20, n3=20/2=10)

n4=9/2=4.5 rounded to 5.

It should be noted that the rounding may be made to an integer near the nearest integer for convenience. Her n2 was rounded to 20 instead of 18 for convenience.

Conclusion

The present invention relates to a retrofit kit that can be used to retrofit exit signs so that they can operate with LEDs. The kit includes a printed circuit board (PCB), arrays of LEDs and various hardware to install the board and LEDs in an existing exit sign.

The following are features of the present invention:

1) The Driver On-Board (DOB) Printed wiring board consists of an input fuse, Metal Oxide Varistor (MOV), a bridge rectifier to convert the input AC voltage to DC voltage pulses, a plurality of Surface mount Light Emitting diodes (LEDs) connected in groups and an integrated circuit driver (IC Chip) to provide necessary power to these LEDs. The IC chip provides optimum power to the LEDs and Power Factor Correction to the circuit 2) The input voltage can be 120 v, 60 Hz or 277 v 60 Hz enabling the Luminaire to operate on dual voltages.

3) The IC Chip senses the amplitude of the input voltage and supplies accordingly only the necessary power to the LEDs in four groups.

4) An optional polycarbonate diffuser can be integrated into this system that can spread the output lumens of the LEDs to uniform light output and reduce the characteristic Dot Matrix lighting effect produced by the LEDs.

5) The optional diffuser absorbs only 15 percent of light output approximately making the luminaire more efficient in delivering more useful output lumens per input watt.

6) The use a very light weight IC chip to dive the LEDs reduces the overall weight of the luminaire.

7) The Luminaire can operate continuously for an estimated 50,000 hours without replacing any components.

8) The LED arrays can be chosen to produce color temperature from 4000 to 5200 degrees K.

9) The integral IC Chip provides the optimum constant current of 35 mA at 120 V input and 15 mA at 277 V input.

10) The Luminaire can be quickly mounted by 2 stainless steel clips

11) The LEDs are wired in series and parallel in groups for efficient lighting of Exit Signs.

12) The diffuser material meets UL 94-5V of Underwriters Laboratory (UL) requirement for flame retardency.

13) The luminaire can be fabricated with varying lengths with a plurality of LEDs.

14) The luminaire can be used with Edge-Lit or Box-type Exit signs.

Several descriptions and illustrations have been provided to aid in understanding the present invention. One with skill in the art will realize that numerous changes and variations are possible without departing from the spirit of the invention. Each of these changes and variations is within the scope of the present invention.

We claim:

1. A light emitting diode (LED) luminaire retrofit kit used with exit signs comprising:

a printed wiring board that includes an input fuse, a metal oxide varistor (MOV), a rectifier to convert AC input voltage to DC voltage pulses each having a periodic functional voltage curve of $V_0$* f(t) with a period normalized to pi seconds, a plurality of surface-mount LEDs connected in a plurality of arrays, and an integrated circuit (IC) driver chip to provide power to the LEDs, wherein, the IC driver chip provides optimum power to the LEDs, and power factor correction;

wherein, with $V_0$ normalized to 1 volt and circuit resistance normalized to 1 ohm, a normalized average power is (A=f(t)dt integrated from 0 to pi)/pi watts;

wherein there are a total of N LEDs and K arrays, where N and K are positive integers with K<N; each array containing a particular number of LEDs;

wherein the arrays are constructed such that the N LEDs have been allocated to the K arrays prior to manufacture by allocating the first array a quantity of (N/A—rounded up to an integer) LEDs, and allocating each remaining array by dividing a remaining number of LEDs after each allocation by the A and rounding to up an integer.

2. The light emitting diode (LED) luminaire retrofit kit of claim 1, wherein N=70, K=4 and A=2.

3. The light emitting diode (LED) luminaire retrofit kit of claim 2, wherein a first array has 35 LEDs, a second array has 20 LEDs, a third array has 10 LEDs and a fourth array has 5 LEDs.

4. The light emitting diode (LED) luminaire retrofit kit of claim 1, wherein the input voltage can be 120V, 60 Hz or 277V, 60 Hz enabling the luminaire to operate on dual voltages.

5. The light emitting diode (LED) luminaire retrofit kit of claim 1, wherein the IC driver chip senses the amplitude of the input AC voltage, and supplies accordingly only necessary power to the LEDs in the K arrays.

6. The light emitting diode (LED) luminaire retrofit kit of claim 5, wherein K=4.

7. The light emitting diode (LED) luminaire retrofit kit of claim 1, further comprising an optional polycarbonate diffuser.

8. The light emitting diode (LED) luminaire retrofit kit of claim 7, wherein the diffuser absorbs only 15 percent of light output or less.

9. The light emitting diode (LED) luminaire retrofit kit of claim 1, wherein the LED arrays are chosen to produce color temperature from 2500 to 500 degrees K.

10. The light emitting diode (LED) luminaire retrofit kit of claim of claim 1, wherein the IC driver chip provides a constant current of 35 mA at 120V input and 15 mA at 277V input AC voltage.

11. The light emitting diode (LED) luminaire retrofit kit of claim 1, wherein the luminaire can be mounted by 2 stainless steel clips.

12. The light emitting diode (LED) luminaire retrofit kit of claim 1, wherein the luminaire can be used with edge-kit or box-type exit signs.

13. A light emitting diode (LED) luminaire retrofit kit used with exit signs comprising:

a printed wiring board (PCB) that includes an input fuse, a metal oxide varistor (MOV), a bridge rectifier to convert 60 Hz sinusoidal AC input voltage to DC voltage pulses, a plurality of surface-mount LEDs connected in a plurality of arrays, and an integrated circuit (IC) driver chip to provide power to the LEDs, wherein, the IC driver chip provides power to the LEDs, and power factor correction;

wherein there are a total of N LEDs and K arrays, each array containing a particular number of LEDs;

wherein the arrays are constructed such that the N LEDs have been allocated to the K arrays prior to manufacture by allocating the first array a quantity of (N/2—rounded up to an integer) LEDs, and allocating each remaining array by dividing a remaining number of LEDs after each allocation by the 2 and rounding to up an integer.

14. The light emitting diode (LED) luminaire retrofit kit of claim 13, wherein a first array has 35 LEDs, a second array has 20 LEDs, a third array has 10 LEDs and a fourth array has 5 LEDs.

15. The light emitting diode (LED) luminaire retrofit kit of claim 13, wherein the input voltage can be either 120V, 60 Hz or 277V, 60 Hz, enabling the Luminaire to operate on dual voltages without additional wiring.

16. The light emitting diode (LED) luminaire retrofit kit of claim 13, further comprising an optional polycarbonate diffuser, wherein the diffuser absorbs only 15 percent of the light output or less.

17. The light emitting diode (LED) luminaire retrofit kit of claim 13, wherein, the LED arrays are chosen to produce color temperature between 2500 to 500 degrees K.

18. The light emitting diode (LED) luminaire retrofit kit of claim 13, wherein the PCB does not require regulatory radiated emission testing.

19. The light emitting diode (LED) luminaire retrofit kit of claim 13, wherein a first array has 35 LEDs, a second array has 19 LEDs, a third array has 10 LEDs and a fourth array has 6 LEDs.

* * * * *